US008272890B2

(12) United States Patent
Ribeau et al.

(10) Patent No.: US 8,272,890 B2
(45) Date of Patent: Sep. 25, 2012

(54) MODULAR ADAPTER FOR A CONNECTOR INSERT AND CONNECTION UNIT COMPRISING SUCH MODULAR ADAPTERS

(75) Inventors: Pascal Ribeau, Le Mans (FR); Serge Leroyer, Le Mans (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 12/547,691

(22) Filed: Aug. 26, 2009

(65) Prior Publication Data

US 2010/0062632 A1 Mar. 11, 2010

(30) Foreign Application Priority Data

Aug. 26, 2008 (FR) ..... 08 55726

(51) Int. Cl.
*H01R 13/60* (2006.01)

(52) U.S. Cl. ..... 439/540.1; 439/701

(58) Field of Classification Search ..... 439/271, 439/587, 607.02, 598, 655, 685, 692, 660, 439/600, 701, 744, 540.1
See application file for complete search history.

(56) References Cited

U.S. PATENT DOCUMENTS 4,618,198 A 10/1986 Dale et al.
4,973,268 A * 11/1990 Smith et al. ..... 439/595
5,720,630 A 2/1998 Richmond et al.
6,241,551 B1 6/2001 Watanabe
6,558,178 B2 * 5/2003 Nakamura ..... 439/271
6,582,256 B2 * 6/2003 Sakurai et al. ..... 439/701
7,182,603 B1 * 2/2007 Koneda et al. ..... 439/34

FOREIGN PATENT DOCUMENTS

DE 203 15 666 U1 12/2003

OTHER PUBLICATIONS

French Search Report dated Mar. 18, 2009 with category translation attached.

* cited by examiner

*Primary Examiner* — Tho D Ta
(74) *Attorney, Agent, or Firm* — RatnerPrestia

(57) ABSTRACT

The invention refers to a modular adapter for a connector insert, characterized in that it comprises a hollow body provided with a through cavity for receiving a connector insert, an external wall of said hollow body being provided with reversible retention means able to cooperate with the internal wall of a through hole in a connector box in which said adapter is intended to be mounted. The invention also refers to a connection unit comprising two modular adapters, respectively male and female adapters.

17 Claims, 2 Drawing Sheets

MODULAR ADAPTER FOR A CONNECTOR INSERT AND CONNECTION UNIT COMPRISING SUCH MODULAR ADAPTERS

CROSS REFERENCE TO RELATED APPLICATIONS

This application claims priority to French Patent Application No. 200855726, filed Aug. 26, 2008, the contents of which are incorporated by reference herein for all purposes.

FIELD OF THE INVENTION

The invention refers to a modular adapter for receiving an electric or pneumatic connector insert or other, in order to enable an easy assembling and disassembling of such a connector insert in a connector box.

The invention finds applications in the connector industry and more particularly in the aviation connector industry, which uses a lot of connector boxes subjected to an important maintenance and surveillance.

BACKGROUND OF THE INVENTION

It is currently known a connector box, for example with a circular shape, in which an insert, for example with a circular cylindrical shape, provided with electrical contacts, is directly mounted. This insert, such as an insert for the connection standard 38999, is fixed by sticking it in the corresponding circular cylindrical orifice in the connector box.

Once the insert is stuck in the housing in the connector box, an operator connects the back ends of the contacts, housed in the insert, to cables. The wiring step must then be realized at the connection place, and notably directly in the aircraft provided with such a connector.

The maintenance of such a connector box needs to disassemble the entire box and, if an insert is defective, to replace the entire box since the insert is irreversibly stuck inside said box.

Moreover, such connector boxes advantageously comprise a shielding function, in order to enable the electrical continuity between two inserts housed in two complementary connector boxes, such as a plug and a socket, as well as a sealing function between said plug and said socket, in order to ensure the connection tightness. Thus, such boxes must be realized with a high precision, which means an important cost when replacing the entire box even though only some inserts need to be replaced.

SUMMARY OF THE INVENTION

The object of the invention is to provide a connector box in which all or some of the inserts can be disassembled, in order to make its maintenance easier, as well as to save time when assembling and wiring said inserts in the box. Another object of the invention is to simplify the structure of the boxes for receiving at least one connector insert, notably in order to reduce their manufacturing cost, by including the sealing function and/or the electrical continuity function directly at the inserts and not anymore at said boxes.

In order to achieve all or part of these objects, the invention proposes an intermediary connecting piece, or adapter, in which the insert, such as a circular insert of the connecting standard 38999, is housed and an external outline of which is adapted to be housed in a reversible manner in a specific housing in a connector box being able to receive such an intermediary connecting piece. For example, the insert is stuck in the intermediary connecting piece, in the way as it has been stuck till now directly in the connector box. According to the invention, the connecting piece is clipped or fitted into a corresponding housing in the connector box, so as to be easily disassembled, notably with the help of a specific tool.

The contacts mounted in the insert can be wired at the workshop, once the insert is mounted in the intermediary connecting piece, before its insertion into the connector box. Thus, it is a complete module which comprises the insert as well as the wired contacts and which is mounted in the connector box located, for example, in an aircraft.

Moreover, when an insert needs to be replaced, the only thing to do is to disassemble the intermediary connecting piece provided with the concerned insert and to replace it by another one, without disassembling and replacing the entire connector box.

Advantageously, the body of the intermediary connecting piece is made out of a metal or a metal-coated plastic material in order to realize an electrical continuity with a complementary intermediary connecting piece when connecting together two complementary connector boxes comprising such connecting pieces. Thus, the shielding function, which is at present realized by the connector boxes, can be suppressed, said boxes being then simpler to realize and able moreover to be entirely made out of a composite material, without any metallization.

It is also possible to provide at the intermediary connecting pieces junction sealing means for ensuring the connection tightness between two inserts in two complementary connector boxes. There again, it enables to suppress the sealing means which are at present integrated in the connector boxes and thus to simplify the machining or molding of said connector boxes.

It is also possible to provide the braid attachment or the cable shield or the standard back connecting pieces no longer on the connector boxes but directly on the intermediary connecting pieces, which enables once again to simplify the machining of said connector boxes. Moreover, in case the intermediary connecting pieces according to the invention have a general circular cylindrical shape, it is then advantageously possible to use circular back connecting pieces, which are more standard than rectangular back connecting pieces.

Furthermore, when the sealing function and the electrical continuity function are included in the intermediary connecting piece, i.e. at the insert, the means for the electrical continuity and the junction sealing can be standardized, which thus increases the modularity of theses units connecting pieces/inserts. The only thing to do is to provide the connector boxes with the locking/unlocking and general attachment functions.

Thus, the object of the invention is to provide a modular adapter for a connector insert, characterized in that it comprises a hollow body provided with a through cavity for receiving a connector insert, an external wall of said hollow body being provided with reversible retention means able to cooperate with the internal wall of a through hole in a connector box in which said adapter is intended to be mounted.

Such an adapter is particularly intended for an electrical connector insert, but such an adapter can be used with inserts of pneumatic or fluidic connectors or other.

The hollow body of the modular adapter has preferably a circular cylindrical shape, for receiving in its cavity, also with a circular cylindrical shape, an insert with a circular cylindrical shape, and notably a standard circular cylindrical insert. Of course, if the insert has a general rectangular shape, the cavity of the hollow body can then also have a rectangular outline which corresponds to the outline of said insert.

The insert is provided with contacts longitudinally extending in canals in said insert, so that the opposed ends of the contact open at two opposed ends of the insert and the hollow body.

"External wall" of the hollow body means the wall directed to the outside, relative to its cavity, and is intended to be in contact with the wall of a cavity in a connector box, in which the modular adapter must be inserted.

The reversible retention means are formed, for example, by metallic or plastic clips intended to be clipped into corresponding recesses in the wall delimiting a cavity of the connector box in which the modular adapter must be housed, such reversible retention means being advantageously easy to disassemble with a tool. Moreover, it is possible to provide a plurality of clips arranged on an external perimeter of said modular adapter and having various dimensions, so as to form at the same time a polarization means for mounting said adapter into a connector box comprising several cavities intended each to receive an adapter.

Advantageously, the external wall of the hollow body of the modular adapter is provided with a gasket for ensuring the tightness between said modular adapter and a connector box in which it is intended to be mounted.

Thus, in case of a modular adapter with a circular cylindrical shape, the gasket is a circular gasket conformed to an external perimeter of the hollow body. The gasket is preferably a flat lobed gasket enabling to have a perfect tightness after the adapter has been mounted in the connector box.

Advantageously, the hollow body of the modular adapter is made out of a metal-coated plastic material.

Thus, the hollow body can be molded with a very high precision and then coated with a external and/or internal metallic layer for ensuring the electrical continuity between two metal-coated adapters provided with complementary inserts when connecting two connector boxes with such adapters. The external metallic layer can be deposited by using any conventional deposition process.

Otherwise, it is possible to make a modular adapter entirely out of a metal.

The modular adapter according to the invention can be specifically intended to receive a female connector insert, or a male connector insert. A modular adapter according to the invention, receiving a female connector insert, is specifically adapted to be connected to a modular adapter according to the invention receiving a male connector insert, or inversely.

Advantageously, the hollow body of a modular adapter intended to receive a female connector insert, to be mounted into a socket, comprises a connection end provided with fitting elements intended to cooperate with complementary fitting means on a complementary modular adapter, around which said connection end must be mounted.

When connecting two modular adapters, the connection end of the female modular adapter surrounds the connection end of the male modular adapter. Then, the complementary fitting elements on the female modular adapter cooperate with complementary fitting elements on the male modular adapter, so as to form a reversible fitting system for maintaining the connection.

For example, the female fitting elements are formed by flexible fins on the wall of the hollow body forming the connection end. The male fitting elements are formed by radially protruding elements on the external wall of the hollow body at its connection end.

Advantageously, the internal wall of the cavity of the hollow body of the female modular adapter is provided with a coupling gasket for ensuring the tightness of the connection between said modular adapter and a complementary male modular adapter.

Preferably, for a greater simplification of the structure of the connector box intended to receive such modular adapters, it is possible to provide, in case of a female modular adapter, a back end of the hollow body, opposed to the connection end, with shaped elements for connecting said adapter to a cable.

In the same way, in case of a male modular adapter, a back end of the hollow body, opposed to the connection end, is provided with shaped elements for connecting said adapter to a connecting piece, such as a screw thread for screwing a connecting piece which can be standard.

The invention also relates to a connection element comprising a modular adapter according to the invention and an insert, said insert being preferably mounted in an irreversible manner in the cavity of the hollow body of the adapter.

The invention also relates to a connection unit comprising a female connection element, comprising a female modular adapter and an insert for receiving female contacts, and a male connection element, comprising a male modular adapter and an insert for receiving male contacts, said modular adapters being able to be connected together by means of their connection end.

The connection unit can also comprise a socket in which the female connection element is housed, and a plug in which the male connection element is housed.

BRIEF DESCRIPTION OF THE DRAWINGS

The invention will be better understood from the following description and the annexed figures which represent the invention in an indicative and non-limitative manner. In the figures:

In FIG. 1, it is represented a female connection element provided with a female modular adapter 1 and an insert 4.

DETAILED DESCRIPTION OF PREFERRED EMBODIMENTS OF THE INVENTION

Figure 1:
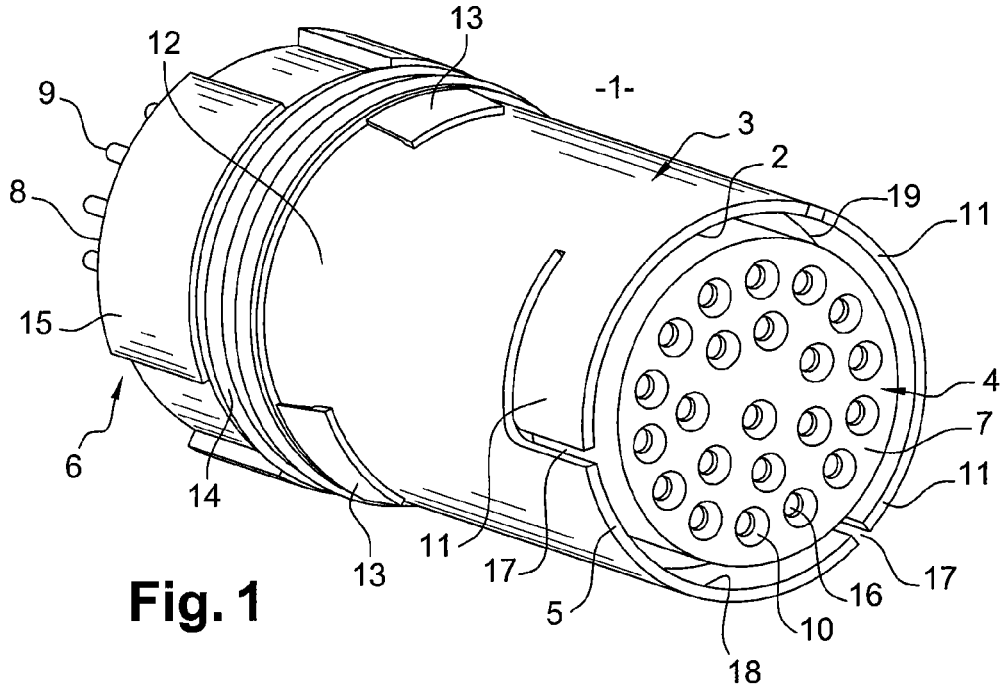
FIG. 1 shows a perspective view of a female connection element according to an embodiment of the invention.

In FIG. 1, it is represented a female connection element provided with a female modular adapter 1 and an insert 4.

The hollow body 3 of the female modular adapter 1 has the shape of a hollow tube. The cavity 2 is a through-cavity in that it opens at both ends 5, 6 of the hollow body 3, so that the female insert 4 which is housed therein has a front open end 7 and a back open end 8. The front end consists in the connection end intended to be connected to a male connector insert, the back end being the end intended to be connected to a cable or other.

Contacts 9 extend in longitudinal canals 10, which also have open ends and longitudinally extend through the female insert 4. The barrels 16 of the contacts 9 open at the connection end 5.

Figure 2:
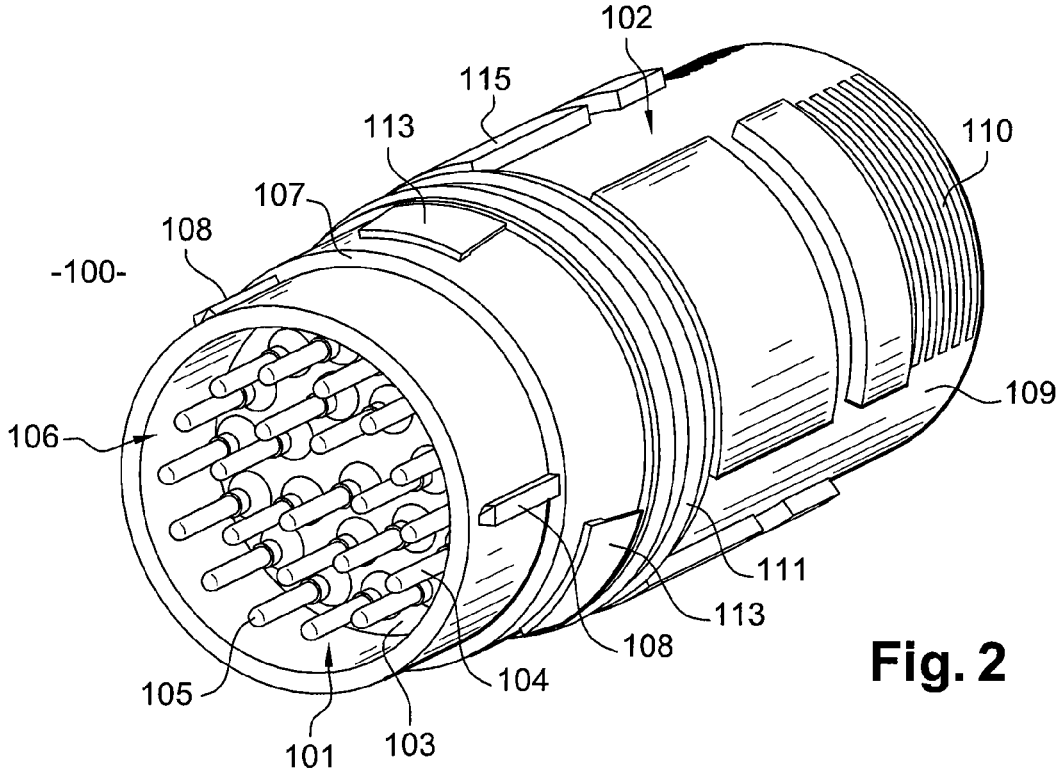
FIG. 2 shows a perspective view of a male connection element according to another embodiment of the invention.

The hollow body 3 is provided, at its connection end 5, with three flexible fins 11, formed by a cutout in the thickness of the wall of the hollow body 3, said flexible fins 11 being able to move apart for positioning complementary fitting elements on a male modular adapter (FIG. 2).

The external wall 12 of the hollow body 3 is provided with reversible retention means 13, formed here by elastic clips. The clips 13 are intended to clip into complementary recesses in the internal wall of a cavity in a connector, in which the female modular adapter 1 must be housed (FIG. 5).

A flat circular gasket 14 surrounds an external perimeter of the external wall 12 of the hollow body 3. This gasket 14 is intended to ensure the tightness of the connection between the modular adapter 1 and the connector box in which it will be housed.

Figure 5:
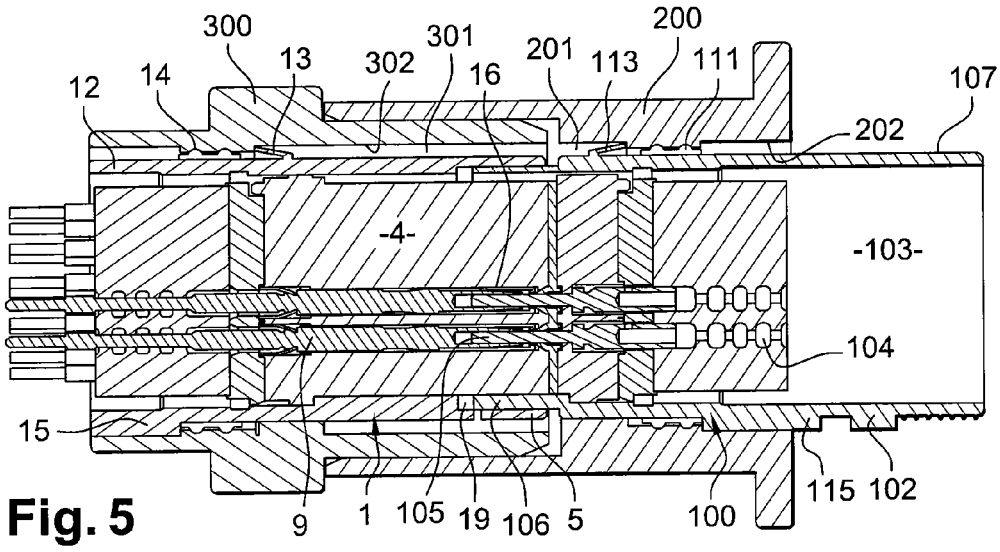
FIG. 5 shows a longitudinal section of two male and female connection elements according to the invention, connected one together.

The back end 8 of the hollow body 3, opposed to the connection end 5, is advantageously provided with shaped elements 15 intended to realize the mechanical stop for the body 3 when it is inserted into the house of the connector (FIG. 5).

In FIG. 2, it is represented a male connection element comprising a modular adapter 100 and a male connector insert 103.

"Male modular adapter" means an adapter provided with a male connector insert 103 housed in a cavity 101 of its hollow body 102. The male insert 103 is stuck in the cavity 101, and cannot be removed, even accidentally, from the female modular adapter 1.

Longitudinal canals extend through the male insert 103 and contacts 104, each of them having a male end 105 which opens at a connection end 106 of the hollow body 102 of said modular adapter 100, extend through said longitudinal canals.

There again, the hollow body 102 has a tubular shape, the insert 104 being conformed to an internal outline of the cavity 101 in which it is stuck.

An external wall 107 of the hollow body 102 is provided, at the connection end 106, with three radially protruding protuberances 108 (only two of them can be seen in FIG. 2). The protuberances 108 are protuberances a longer dimension of which extends along the longitudinal axis of the male adapter 100 and a shaped element of which is adapted to fit into the complementary longitudinal slots made by the cutouts in the external wall 12 of the hollow body 3 of the female modular adapter 1 forming the fins 11.

Thus, when the connection end 106 of the male modular adapter 100 is inserted into the connection end 5 of the female modular adapter 1, the protuberances 108 fit into the slots 17 by slightly moving the flexible fins 11 outwards. In this way, the connection end 106 of the hollow body 102 of the male modular adapter 100 comes in between the internal wall of the hollow body 3 of the female modular adapter 1 and the external wall of the female insert 4 it contains (FIG. 5), in order to insert the male ends 105 of the contacts 104 of the male modular adapter 100 into the barrels 16 of the contacts 9 of the female modular adapter 1.

Advantageously, in order to ensure the tightness of the connection between the female modular adapter 1 and the male modular adapter 100, it is possible to provide an internal wall 18 of the hollow body 3 of the modular adapter 1, bordering the connection end 5, with a coupling gasket 19 (FIGS. 1 and 5). The coupling gasket 19 is conformed to an external outline of the cavity 2 of the modular adapter 1. In case the external wall 107 of the male modular adapter 100 is provided with the protuberances 108 and the external wall 12 of the hollow body 3 of the female modular adapter 1 is provided with cutouts comprising longitudinal slots 17, the coupling gasket 19 is interrupted at said longitudinal slots 17, so that each longitudinal slot 17 is bordered on both sides by an end of the coupling gasket 19.

As we can see in FIG. 2, the external wall 107 of the hollow body 102 of the male modular adapter 100 is also advantageously provided with clips 113 intended to clip into complementary recesses in the internal wall of a cavity in a connector, in which the male modular adapter 100 must be housed (FIG. 5).

The clips 13 on the external wall 12 of the hollow body 3 of the female modular adapter 1, as well as the clips 113 on the external wall 107 of the hollow body 102 of the male modular adapter 100, are distributed on an external perimeter of the concerned hollow body and have various sizes so as to be able to serve at the same time as polarization system when positioning said modular adapters 1, 100 in the specific housings in the connector boxes.

The hollow body 102 is provided with shaped elements 115 between the ends 105 and 109, which are advantageously intended to be used as a mechanical stop for the hollow body 102 when it is inserted into the housing of the connector (FIG. 5).

A back end 109 of the hollow body 102 of the male modular adapter 100, opposed to the connection end 106, is advantageously provided with a screw thread 110 for fixing a standard connecting piece. This screw thread can also be provided with longitudinal teeth which are distributed on the entire perimeter of the back end 109 and are very well adapted to the teeth which are generally found on the bodies of standard connecting pieces.

Moreover, the external wall 107 of the hollow body 102 of the male modular adapter 100 comprises a circular gasket 111 around an external diameter of said hollow body 102, on its entire perimeter. This gasket is intended to be crushed against the internal wall of the cavity of the connector in which said modular adapter 100 will be housed, so as to ensure the tightness of the connection between said modular adapter 100 and said connector (FIG. 5).

Figure 3:
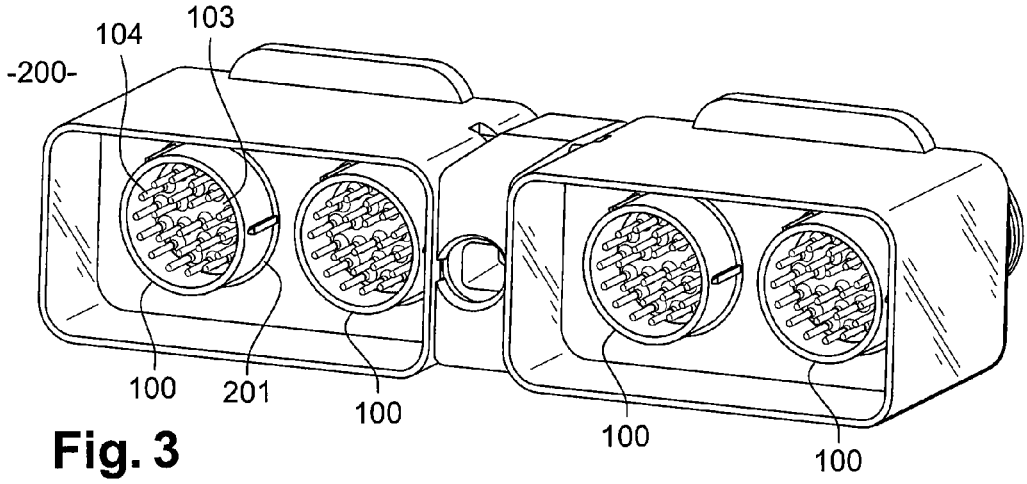
FIG. 3 shows a front view of a plug provided with a plurality of male modular adapters according to the invention.

In FIG. 3, it is represented an example of a male connector box 200, or plug, with a general rectangular shape, including four circular cylindrical cavities 201, each of them receiving a connection element according to the invention. Each male modular adapter 100 of a connection element is clipped into a cavity 201. The modular adapter 100 is thus maintained in position in said box 200, as well as the insert 104 stuck in said adapter 100, said modular adapter 100 being able to be disassembled by means of a specific disassembling tool well known by the man of a man skilled in the art.

Figure 4:
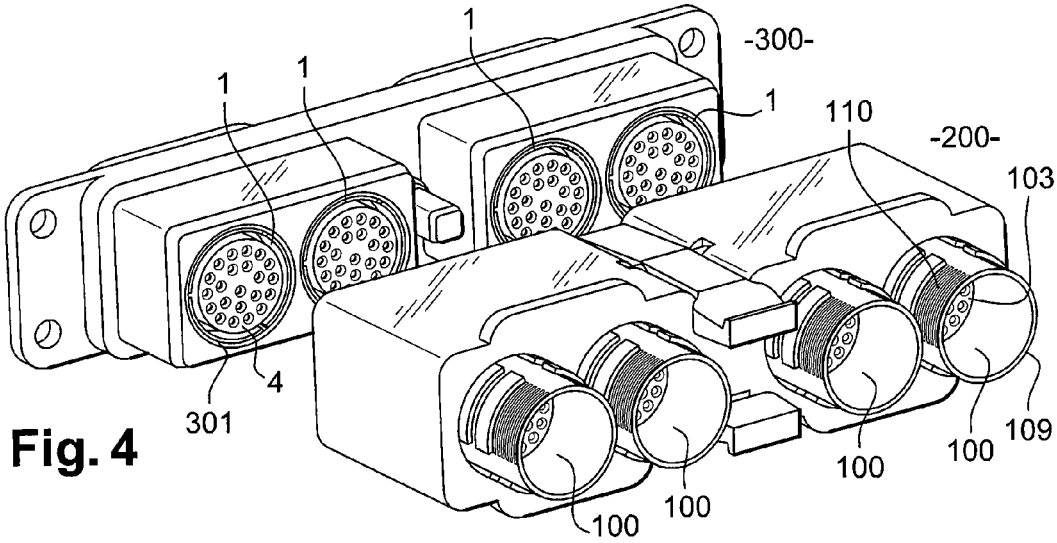
FIG. 4 shows a perspective view of a unit socket/plug provided with female connection elements and male connection elements according to the invention.

In FIG. 4, it is represented the plug 200 of FIG. 3 and a female connector box 300, or socket, to be connected together, each having a general rectangular shape, and each being provided with four cavities for receiving a male or female connection element, the connection between the plug 200 and the socket 300 enabling the connection between each male modular adapter 100 with a female modular adapter 1.

Advantageously, it is possible to mount the modular adapter 1, 100 and its insert 4, 103 at the workshop, but also to wire the contacts 9, 104 of said insert 4, 103 at the workshop and to bring the unit modular adapter/insert/cables into the connector box 200, 300. It enables the series mounting of the modular adapters 1, 100 provided with inserts 4, 103, contacts 9, 104 and corresponding cables (not represented) and, in the final connection stage, to bring these said units at the place where they must be connected, notably an aircraft.

In FIG. 5, it is represented a longitudinal section of a connection between a plug 200 and a socket 300, each of them being provided with a modular adapter 1, 100 according to the invention.

The external gasket 111, 14 on the external wall 107, 12 of the hollow bodies 102, 3 of the modular adapters 100, 1 are crushed against the internal wall 302, 202 of the cavities 301, 201 in which said modular adapters are housed, so as to ensure a perfect tightness of the connection between said adapters 100, 1 and the corresponding boxes 300, 200.

Also, the elastic clips 113, 13 cooperate with complementary shaped elements on the internal walls 302, 202 of the socket 300 and the plug 200, so that the modular adapters 100, 1 and their associated inserts 103, 4 can be maintained in position therein because they are then blocked in position by the clips 113 and the shaped element 115 and by the clips 13 and the shaped element 15, respectively.

The coupling joint 19 bordering the connection end 5 of the hollow body 3 of the female modular adapter 1 is pressed by the connection end 106 of the hollow body 101 of the male modular adapter 100, so that the tightness of the electrical connection between the contacts 9 of the female insert 4 and the contacts 104 of the male insert 103 is ensured.

In case at least the external wall 12, 107 of the modular adapters 1, 100 is coated with a metal, there is an electrical continuity between both adapters 1, 100.

The invention claimed is:

1. A connector box assembly comprising:

a male connector box forming a plurality of cavities arranged in at least one series;

a female connector box forming a plurality of cavities arranged in at least one series, the plurality of cavities of the female connector box being configured for coaxial alignment with the plurality of cavities of the male connector box;

a plurality of male modular adapters for placement in the cavities in the male connector box, each male modular adapter comprising:

a hollow body having a cavity; and a male connector insert inside the cavity of the male modular adapter, the cavity of the male modular adapter sized to contain no more than one male connector insert;

a plurality of female modular adapters for placement in the cavities in the female connector box, each female modular adapter comprising:

a hollow body having a cavity; and a female connector insert inside the cavity of the female modular adapter, the cavity of the female modular adapter sized to contain no more than one female connector insert;

each male modular adapter being connected inside one of the cavities of the male connector box in a reversible manner, resulting in a series of said male modular adapters in the male connector box, with each male modular adapter and its respective male connector insert independently connected to and independently removable from the male connector box without connecting or removing the remaining male modular adapters and male connector inserts to and from the male connector box; and each female modular adapter being connected inside one of the cavities of the female connector box in a reversible manner, resulting in a series of said female modular adapters in the female connector box, with each female modular adapter and its respective female connector insert independently connected to and independently removable from the female connector box without connecting or removing the remaining female modular adapters and female connector inserts to and from the female connector box.

2. A connector box assembly according to claim 1, wherein the hollow bodies of either the male modular adapters or the female modular adapters each comprise an external gasket.

3. A connector box assembly according to claim 1, wherein the hollow bodies of the male modular adapters and female modular adapters are made out of a metal or a metal-coated plastic material.

4. A connector box assembly according to claim 1, wherein each female connector insert comprises fitting elements, and each male connector insert comprises complementary fitting means configured to cooperate with the fitting elements of one of the female connector inserts.

5. A connector box assembly according to claim 1, wherein the hollow body of each female modular adapter comprises an internal wall with a coupling gasket for ensuring the tightness of a connection between said female modular adapter and one of the male modular adapters.

6. A connector box assembly according to claim 1, wherein the hollow bodies of either the male modular adapters or the female modular adapters each comprise a back end provided with shaped elements for connecting the back end to a cable.

7. A connector box assembly according to claim 1, wherein the hollow bodies of either the male modular adapters or the female modular adapters each comprise a back end provided with shaped elements for connecting the back end to a connecting piece.

8. A connector box assembly according to claim 1, wherein the male connector inserts of the male modular adapter are fixed in their respective hollow bodies, and the female connector inserts of the female modular adapter are fixed in their respective hollow bodies.

9. A connector box assembly according to claim 1, wherein the male and female connector inserts comprise contacts housed in the male and female connector inserts.

10. A connector box assembly according to claim 1, wherein each male connector insert comprises a connection end and each female connector insert comprises a connection end, and wherein the male and female modular adapters can be connected together by their connection ends to connect their respective connection inserts together.

11. A connector box assembly according to claim 1, wherein the female connector box comprises a socket that houses the female modular adapters, and the male connector box comprises a plug that houses the male modular adapters.

12. A connector box assembly according to claim 1, wherein each of the male and female modular adapters is generally cylindrical in shape.

13. A connector box assembly according to claim 1, wherein each of the cavities in the male and female connector boxes is generally cylindrical in shape.

14. A connector box assembly according to claim 1, wherein the hollow body of each male modular adapter comprises a reversible retention means for engaging the interior of one of the cavities in the male connector box.

15. A connector box assembly according to claim 14, wherein the reversible retention means comprises an elastic tab.

16. A connector box assembly according to claim 1, wherein the hollow body of each female modular adapter comprises a reversible retention means for engaging the interior of one of the cavities in the female connector box.

17. A connector box assembly according to claim 16, wherein the reversible retention means comprises an elastic tab.

* * * * *